US006061040A

United States Patent [19]

Onodera et al.

[11] Patent Number: 6,061,040

[45] Date of Patent: May 9, 2000

[54] DRIVE CIRCUIT FOR DISPLAY DEVICE

[75] Inventors: Junichi Onodera; Masamichi Nakajima; Asao Kosakai; Masayuki Kobayashi; Hayato Denda; Seiji Matsunaga; Toru Aida, all of Kanagawa, Japan

[73] Assignee: Fujitsu General Limited, Kawasaki, Japan

[21] Appl. No.: 08/683,273

[22] Filed: Jul. 18, 1996

[30] Foreign Application Priority Data

Jul. 21, 1995 [JP] Japan ..... 7-207781
Jul. 21, 1995 [JP] Japan ..... 7-207782

[51] Int. Cl.[7] ..... G09G 3/22

[52] U.S. Cl. ..... 345/67; 345/60

[58] Field of Search ..... 345/60, 63, 68, 345/208, 67; 315/169.4

[56] References Cited

U.S. PATENT DOCUMENTS

| | | | |
|---|---|---|---|
| 4,349,819 | 9/1982 | Terakawa | 340/812 |
| 5,089,812 | 2/1992 | Fuse et al. | 340/793 |
| 5,122,792 | 6/1992 | Stewart | 340/793 |
| 5,351,315 | 9/1994 | Ueda et al. | 382/54 |
| 5,436,634 | 7/1995 | Kanazawa | 345/67 |
| 5,596,349 | 1/1997 | Kobayashi et al. | 345/147 |
| 5,760,756 | 6/1998 | Kobayashi et al. | 345/87 |
| 5,790,095 | 8/1998 | Onodera et al. | 345/147 |

*Primary Examiner*—Matthew Luu
*Assistant Examiner*—Jeff Piziali
*Attorney, Agent, or Firm*—Flynn, Thiel, Boutell & Tanis, P .C.

[57] ABSTRACT

In a display device in which each group of plural drive elements takes charge of the drive of plural picture elements (pixels) and the display luminance changes as the number of sustaining pulses changes that are supplied to a plasma display panel, a constant emission luminance characteristic is maintained by increasing the number of sustaining pulses for a larger load when the display load factor is large, and decreasing the number of sustaining pulses for a smaller load when the display load factor is small. When displaying a multi-tone image by a subfield drive method, a display area detect circuit allows the display of an image with constant luminance characteristic despite the variation of the display load factor, and prevents the deterioration of tone characteristic due to the subfield drive method, and further, a half tone display circuit allows the decrease of the bit number thereby simplifying the configuration of the display area detect circuit.

16 Claims, 8 Drawing Sheets

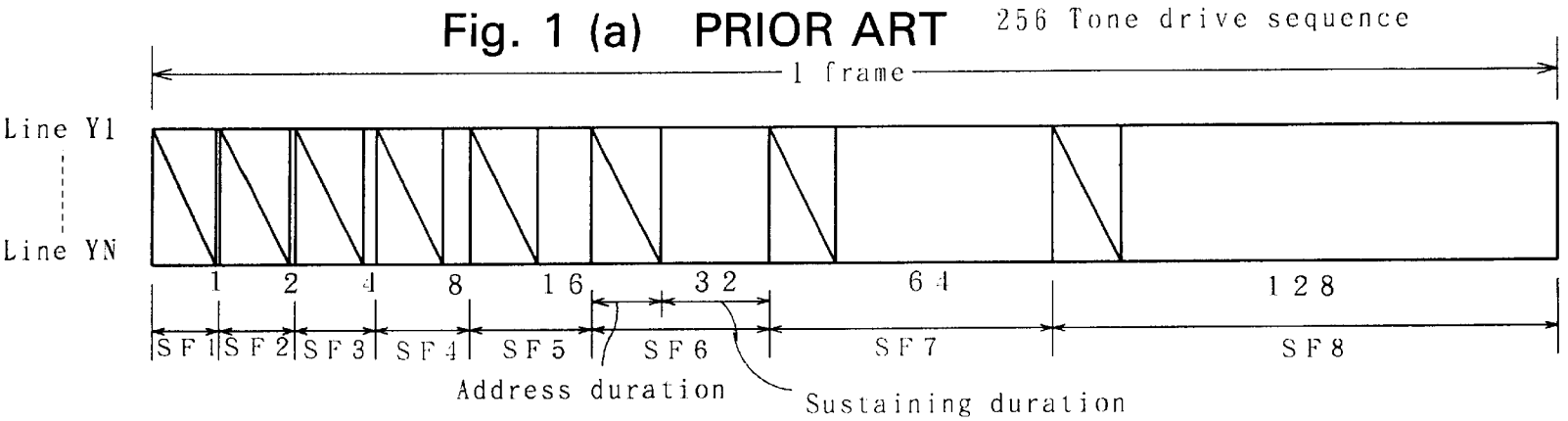
Fig. 1 (a) PRIOR ART
256 Tone drive sequence
1 frame
Line Y1
Line YN
SF1
SF2
SF3
SF4
SF5
SF6
SF7
SF8
1
2
4
8
16
32
64
128
Address duration
Sustaining duration

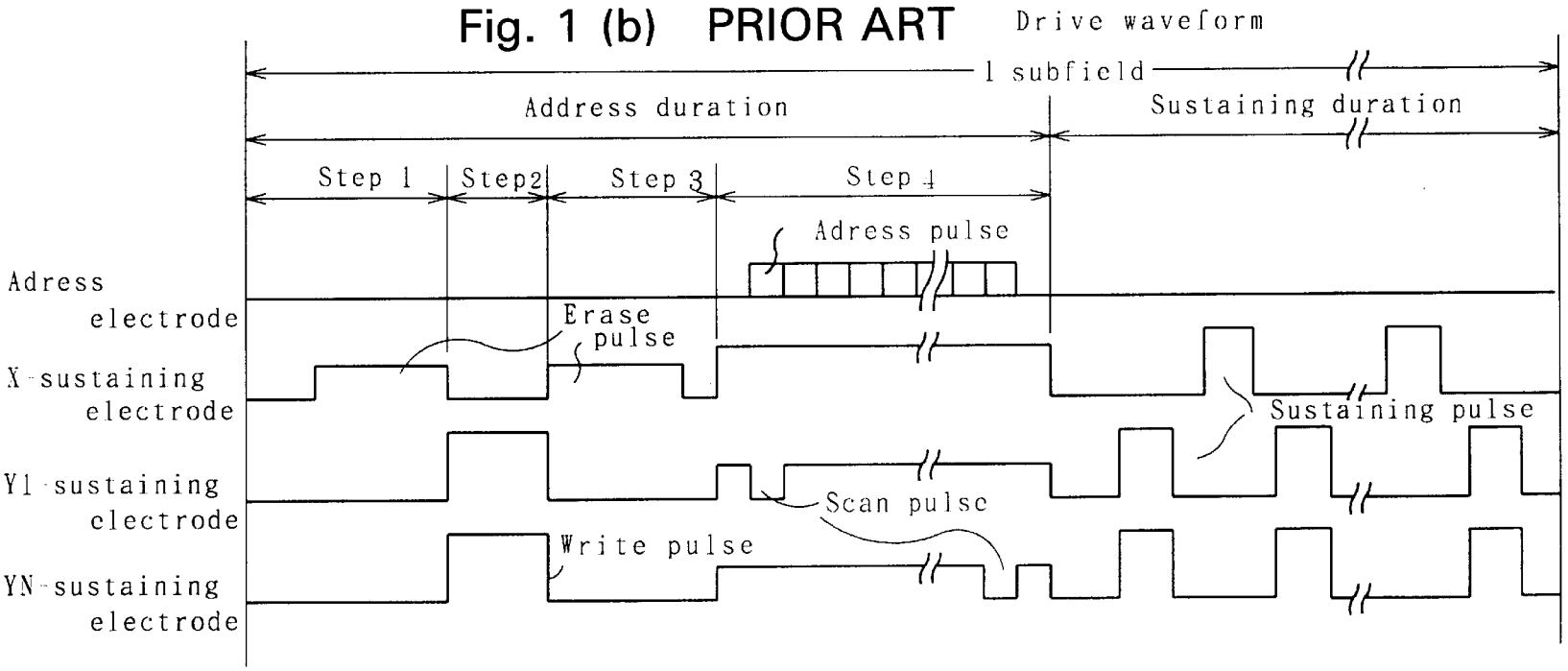
Fig. 1 (b) PRIOR ART
Drive waveform
1 subfield
Sustaining duration
Address duration
Step 1
Step2
Step 3
Step 4
Adress pulse
Erase pulse
Sustaining pulse
Scan pulse
Write pulse
Adress electrode
X-sustaining electrode
Y1-sustaining electrode
YN-sustaining electrode Fig. 8 (a)
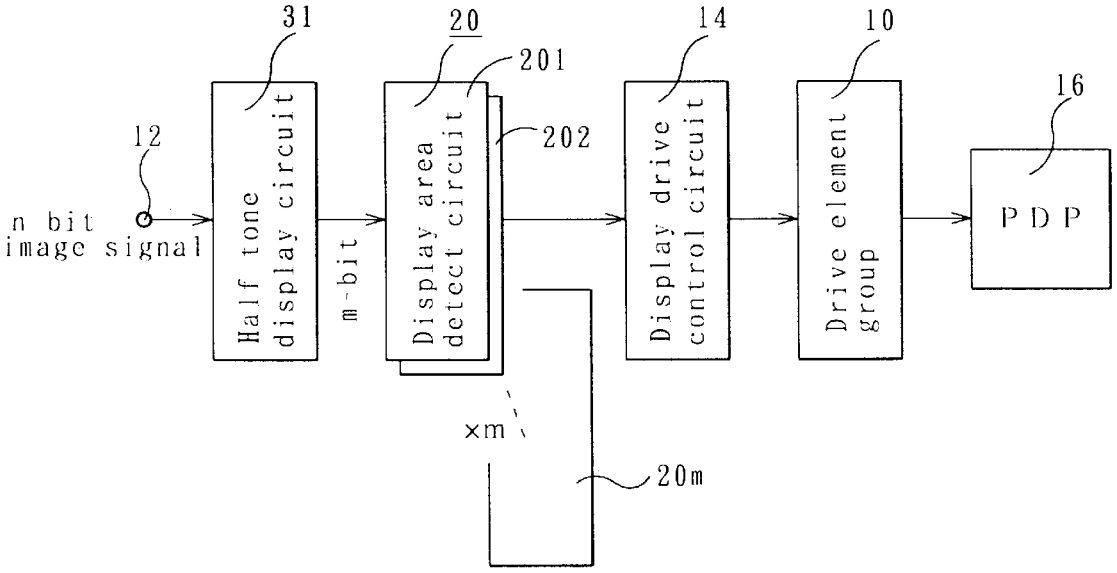
Fig. 8 (b) PRIOR ART
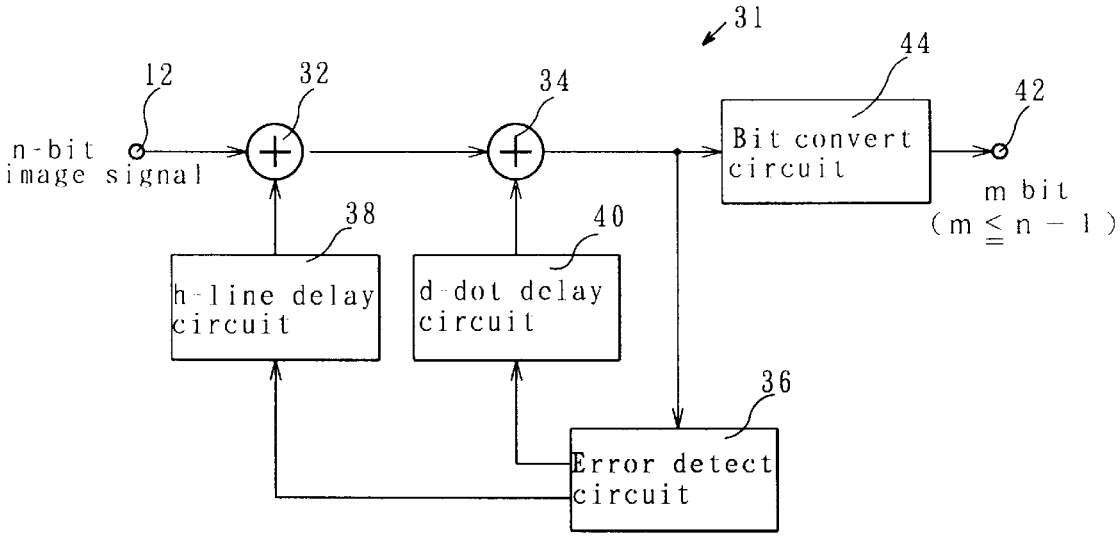

DRIVE CIRCUIT FOR DISPLAY DEVICE

BACKGROUND OF THE INVENTION (1) Field of the Invention

This invention relates to a drive circuit for the display device having plural drive elements each of which drive plural pixels (picture elements), wherein the display luminance has been so designed as to change as the number of the sustaining pulses, sustaining voltage and current provided from each drive element to display panel change based on the input image signal.

The present invention also relates to a drive circuit of a display device that displays multi-tone image by timesharing one screen display duration (one frame, for instance) of display panel into the plural display durations (subfields, for instance) that correspond to the display tone and by weighting the sustaining pulse number of respective divided (time-shared) display durations.

(2) Description of the Prior Art

The driving method of PDP (Plasma Display Panel) is a direct drive by digitalized image input signal. The luminance and tone of the light emitted from the panel face depends on the bit number of the signal dealt with.

AC type PDP features satisfactory characteristics as far as is concerned the luminance and durability. As for the tonal display, however, an ADS subfield method (Address/Display Separate type drive method) has been proposed only recently that enables 256 tones.

FIGS. 1(*a*) and 1(*b*) show the drive sequence and drive waveform of the PDP which is used in this ADS subfield method.

In FIG. 1(*a*), which gives an example of 8-bits 256 tones, one frame consists of eight subfields whose relative ratios of luminance are 1, 2, 4, 8, 16, 32, 64 and 128 respectively. Combination of these luminances of eight screens enables a display in 256 tones. The respective subfields are composed of the address duration that writes one screen of refreshed data and the sustaining duration that decides the luminance level of the subfield. The detail of this configuration is explained in FIG. 1(*b*). In the address duration, a wall charge is formed initially at each pixel simultaneously over all the screens and then the sustaining pulses are given to all the screens for display. The brightness of the subfield is proportional to the number of the sustaining pulses to be set to predetermined luminance. Two hundred and fifty-six tones display is thus realized.

AC type PDP display device has plural drive elements (101, 102, . . . 130n) as shown in FIG. 2. The respective drive elements 101, 102, . . . 10n drive the plural pixels of PDP16 by the drive control signal from a display drive control circuit 14 based on the image signal as input into the image signal input terminal 12. This type of method was however problematical in that the load as against the drive element and the emission luminance differ when the drive voltage (sustaining voltage and address voltage, for instance) is applied to all the plural pixels whose drive is taken charge of by one drive element, that is when the pixels are discharged, and when it is supplied only to a part of the pixels.

Conventionally attempts had been made to solve such a problem by enhancing the capacity of the individual drive elements or by mitigating the load to individual drive elements through an increase of the number of the drive elements. However, this conventional approach was disadvantageous in that though the event of differential emission luminance characteristic can be moderated, it cannot be annihilated and that a large capacity of drive elements had to be prepared. Further the number of drive elements required was too large.

The conventional method was also problematical in that when such display device as shown in FIG. 2 displays a multi-tone image by the ADS subfield method, the tonal characteristic worsens. Let us consider, for example, an image where the most of displayed image is composed of the image level "127" (01111111 by 8-bits binary notation) and the small remaining area is composed of an image level "128" (10000000 by 8-bits binary notation). When the display load factor of MSB (Most Significant Bit) subfield is compared with that of the subfield other than MSB, the former is smaller than the latter. It was unsustainable because this difference in load factor raised the emission luminance characteristic and worsened the tonal characteristic.

To solve such problematical points as above, the applicant has already proposed such a circuit as shown in FIG. 3. That is, a display area detect circuit 20 is inserted between an image signal input terminal 12 and a display drive control circuit 14. The display area detect circuit 20 detects the display area for every certain duration (for example, one frame or one subfield) based on the image signal as input into the image signal input terminal 12 to control the number of the sustaining pulses (drive pulses) in response to the detected area More concretely, the display area detect circuit 20 comprises a display load factor detect circuit (a counter, for instance) that detects the display load factor for a certain duration and the sustaining pulse control circuit [LUT (Look Up Table), for instance] that controls the number of sustaining pulses, sustaining voltage or sustaining current based on the output detected by the display load factor detect circuit. The emission luminance characteristic can thus be maintained constant irrespectively of the display load factor of the display panel. This configuration further prevents the deterioration of the tonal characteristic due to the subfield drive method.

However, the circuit as shown in FIG. 3 was somewhat problematical in that the configuration of the display area detect circuit 20 becomes complicated when one frame of the PDP 16 is time-shared into eight display durations (subfields) corresponding to 8-bits display tones and the number of the sustaining pulses of the respective divided display durations are weighted to display 256 tones of image. This is because we need eight display load factor detect circuits and eight sustaining pulse control circuits for as many subfields. In FIG. 3, the numeral 10 indicates the group of drive elements representing all the drive elements 101, 102, . . . 10n as shown in FIG. 2.

BRIEF SUMMARY OF THE INVENTION

The first purpose of the present invention is to provide a drive circuit for the display device that allows for an image display with constant emission luminance characteristic despite the largeness of the display load factor. In this context the display load factor means the proportion of the drive pixel number (number of lighted up pixels) occupies in the total number of pixels for certain duration (for example, one frame, one subfield or one line).

The second purpose of this invention is to prevent the degradation of the tonal characteristic due to the subfield drive method when it is used in a display device that displays multi-tone image.

The third purpose of the invention is to provide a drive circuit for a display device that can simplify the configuration of the display area detect circuit.

In a display device intended to achieve the first purpose of the invention where plural drive elements take respectively charge of the driving of the plural pixels and the display luminance changes as changes the number of the sustaining pulses provided from each drive element to the display panel based on the input image signal, provided are the display load factor detect means that detects the display load factor for certain duration based on the input image signal, the sustaining pulse control means that controls the sustaining pulse number based on the detecting output of said display load factor detect means that detects the display load factor (number of drive pixels, for instance) for every certain duration (for example, one frame or one subfield), said sustaining pulse control means controlling the number of sustaining pulses based on said detecting output thereby maintaining constant the luminance characteristic of the display panel. This control increases the number of sustaining pulses when the display load factor is large since the load against the drive element is large, while it decreases the same number when the same factor is small since the same load is small.

In order to achieve the second purpose, this invention adopts, as the display device, such display device as displays multi-tone image by subfield drive method; as the display load factor detect means, the counter that counts up the number of drive pixels for one of every display duration out of one screen display duration (for example, one frame) and one division display duration (for example, one subfield); and as the sustaining pulse control means, the sustaining pulse control circuit that controls the number of sustaining pulses based on the counted value of the counter. The counter accumulates the number of the drive pixels for every display duration based on the counted value, and the sustaining pulse control circuit controls the number of sustaining pulses to be provided to the display panel.

Such configuration as above of this invention allows to display image with constant luminance characteristic despite the variation of the display load factor; that is, the luminance characteristic of the display panel can be maintained constant by the sustaining pulse control means that controls the number of sustaining pulses based on the detecting output of the display load factor detect means, and further by the sustaining voltage and current control means that controls the sustaining voltage or current based on the detecting output of he display load factor detect means.

If this display device as adopted can display the multi-tone image by the subfield drive method, then the deterioration of tonal characteristic due to the subfield drive method can be prevented; that is, the luminance characteristic of the display panel is maintained constant by the control, by the sustaining pulse control means, of the sustaining pulse number based on the detecting output of the display load factor detect means.

Let us consider, for example, an image where the most of displayed image is composed of the image level "127" (01111111 by 8-bits binary notation) and the small remaining area is composed of an image level "128" (10000000 by 8-bits binary notation). Under these conditions the control is made so that the number of sustaining pulses is reduced for the subfield of MSB that has a small display load factor, and it is increased for any subfield other than MSB that has a large display load factor. Or else the control reduces the number of sustaining pulses for MSB subfield without changing it for any subfield other than MSB. The degradation of the luminance characteristic because of the subfield drive method can thus be prevented.

A display device intended to achieve the third purpose of the invention, has plural drive elements, the respective drive elements taking charge of the driving of plural pixels, one screen display duration of the display panel being time-shared into such display duration as corresponding to the display tone, the multi-tone image being displayed by weighting the sustaining pulse of respective divided display duration, n-bits (n being any integer not less than 2) of input image signal is converted into m-bits ($m \leqq n-1$) of image signal, and at the same time provided are an intermediate display means that looks for intermediate level from neighboring drive level and a display area detect means that controls the sustaining pulses so that the display area is detected for every constant duration based on the m-bits image signal of the half tone display means and that the luminance characteristic of said display panel is maintained constant on the basis of this detecting output.

Said display area detect means maintains constant the luminance characteristic of the display panel by detecting the display load factor (for example, the number of drive pixels) for every certain duration (one frame or one subfield, for instance) and controlling the sustaining pulses correspondingly, and prevents, at the same time, the deterioration of the tone characteristic due to the subfield drive method. Because the halftone display means concerts the n-bits input image signal into m-bits one ($m \leqq n-1$), and looks for the intermediate level from neighboring drive level to output it at the display area detect means, the conventional number n can be reduced to m of the display load factor detect circuits (counter, for instance) that constitute the display area detect means and of the sustaining pulse control circuit [LUT (Look Up Table), for instance].

This invention provided, by means of such a configuration as above, a display area detect means that detects the display area for every certain duration (one frame, for instance) and controls the sustaining pulses so that the luminance characteristic of the display panel can be maintained constant based on the detecting output, the image display can be made with constant luminance characteristic despite the changing display load factor (number of drive pixels) and that the deterioration of tone characteristic due to the subfield drive method (ADS subfield, for instance) can be prevented.

Since further the halftone display means that converts the n-bits input image signal into m-bits ($m \leqq n-1$) one and obtains the intermediate level from the neighboring drive level, can convert the display area detect means from n-bits into m-bits, the configuration of the display area detect means can be simplified consequently. When, for example, the display area detect means are made to comprise the display load factor detect circuit (for example, counter) that detects the display load factor for every certain duration and the sustaining pulse control circuit (for example, LUT), the number of the display load factor detect circuits and that of the sustaining pulse control circuit can be reduced from n to m (for example, for so many subfields).

Other and further objects of this invention will be obvious upon am understanding of the illustrative embodiments about to be described.

BRIEF DESCRIPTION OF THE DRAWINGS

FIG. 1(*a*) represents a drive sequence of the ADS subfield method.

FIG. 1(*b*) depicts a drive waveform of the ADS subfield method.

FIG. 8(*a*) another block diagram showing the fourth embodiment of the drive circuit of the display device according to this invention.

FIG. 8(*b*) is the prior art block diagram the error variance circuit, an example of the halftone display circuit as shown in FIG. 8(*a*).

DETAILED DESCRIPTION

Figure 2:
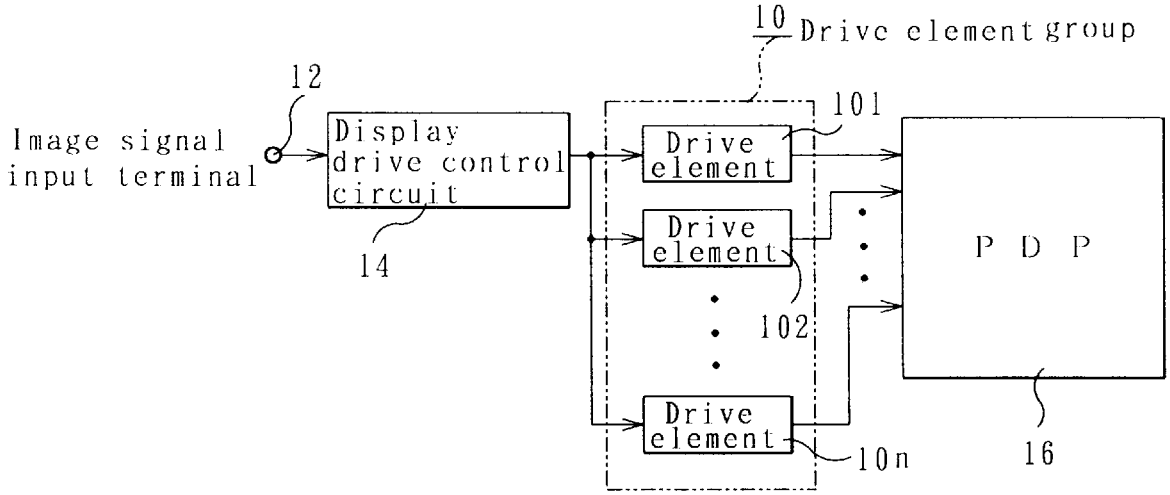
Fig. 2 PRIOR ART
FIG. 2 is a block diagram showing a conventional drive circuit of display device.
Figure 3:
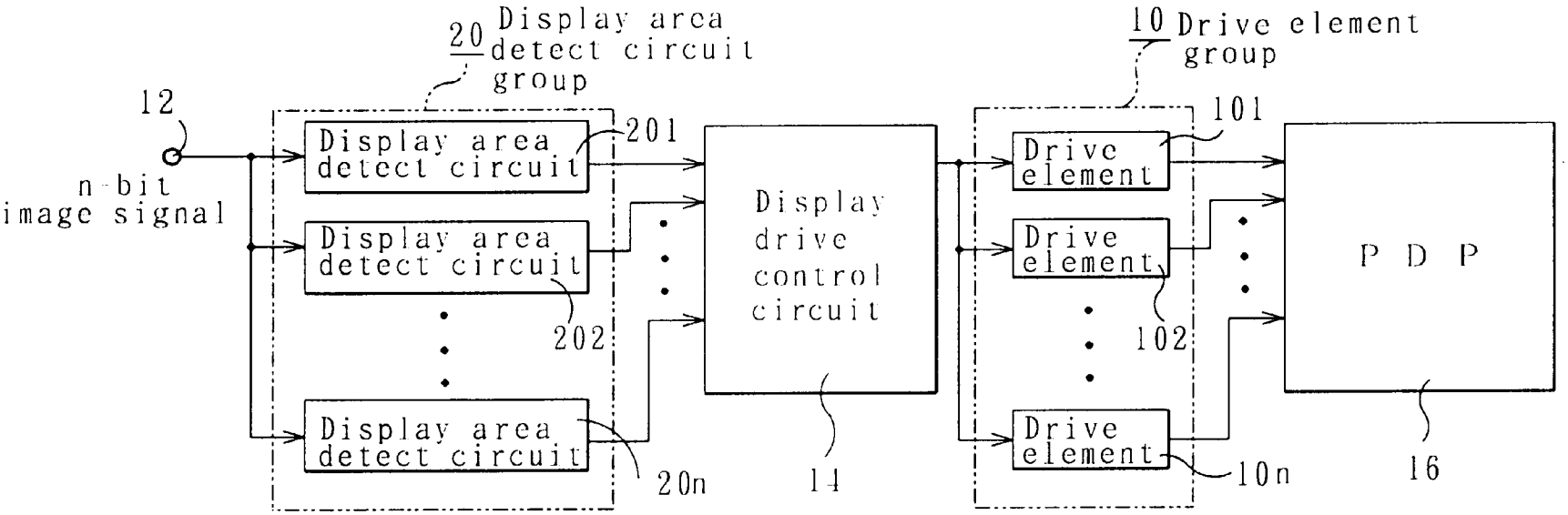
Fig. 3 PRIOR ART
FIG. 3 is a block diagram of the drive circuit of the display device previously proposed by the applicant.
Figure 4:
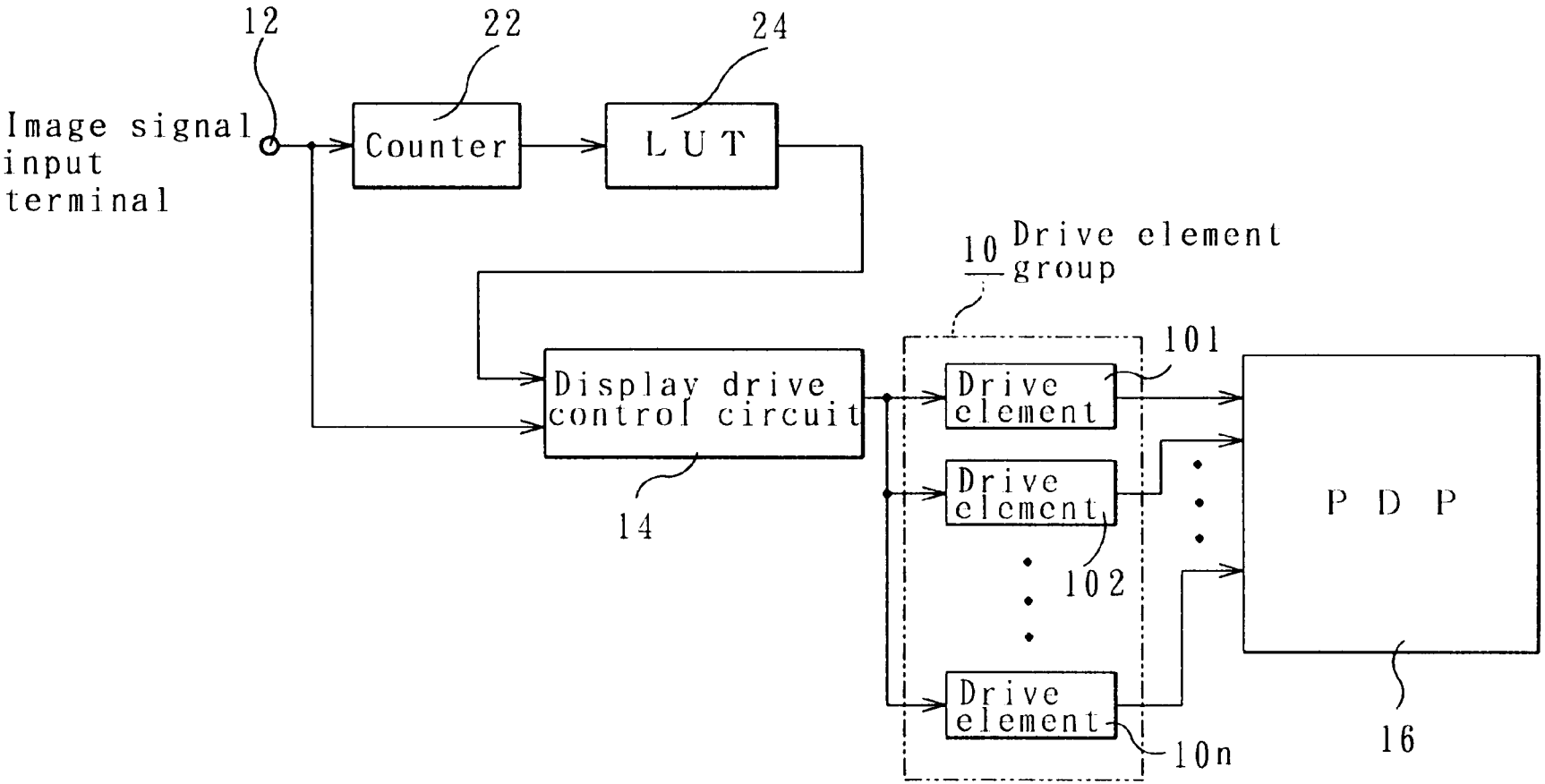
FIG. 4 is a block diagram showing the first embodiment of the drive circuit of the display device according to this invent ion.

Now the first embodiment of this invention will be illustrated referring to FIGS. 4. In FIG. 4, parts with corresponding like numerals in FIG. 2 designate the same elements.

The numeral 12 represents an image signal input terminal. Sequentially connected to the terminal 12 are a display drive control circuit 14, a drive element group 10 (101, 102, . . . 130n) and a plasma display panel (PDP) 16 in this order. As is the case with the conventional one, said display drive control circuit 14 drives and controls the drive element group 10 based on the image signal (image data) input in the image signal input terminal 12, and displays the multi-tone image by ADS subfield. That is, it time-divides one frame of PDP 16 into plural (8, for instance) subfields and weights the sustaining pulse number of each subfield to display the multi-tone image (for example, 8-bits 256 tone image).

Coupled to said image signal input terminal 12 is a counter 22 as an example of display load factor detect means, which counts the number of drive pixels (display area) for every frame or subfield to output the counted value.

Connected on the output side of said counter 22 is the LUT (Look Up Table) 24 as an example of the major element constituting the sustaining pulse control means, which is made up of ROM (Read Only Memory) for example. The LUT 24 stores beforehand in memory the number of sustaining pulses for the drive pixels for every one frame or one subfield in order to maintain constant the luminance characteristic of said PDP 16 irrespectively of the largeness of display load factor, the content of which can be output with the counted value of said counter 22 as address (heading). The data to be stored beforehand in said LUT 24 is obtained from the characteristic data measured of the relationship between the image signal and the emission luminance of the PDP 16 that displayed the multi-tone image by ADS subfield, with each of the drive element group 10 taking charge, for instance, of the driving of plural pixels of the PDP 16.

Said display drive control circuit 14 drives and controls the drive element group 10 using the sustaining pulse number as output from said LUT 24, and maintains always constant the luminance characteristic of the PDP 16 despite the largeness of the display load factor.

Now the action of the drive circuit in FIG. 4 will be explained.

(a) Based on the image signal as input into the image signal input terminal 12, the counter 22 counts up the number of drive pixels (display area) for every one frame or one subfield and outputs the counted value to the LUT 24.

Let us consider, for example, an image where the most of displayed image is composed of the image level "127" (01111111) and the small remaining area is composed of an image level "128" (10000000). The MSB subfield has a small counted value because its drive pixel number, consequently the display load factor is small, while the subfield other than MSB has a great counted value because its drive pixel number, consequently the display load factor is great.

(b) The display drive control circuit 14 receives, from the LUT 24, the number of sustaining pulses to maintain constant the luminance characteristic with the counted value of the counter 22 as an address, controls the drive element group 10 using this sustaining pulse number, and maintains constant the luminance characteristic of the PDP 16. Let us consider, for example, an image where the most of displayed image is composed of the image level "127" (01111111 by 8-bits binary notation) and the small remaining area is composed of an image level "128" (10000000 by 8-bits binary notation). Since the counted value of the MSB subfield is smaller than that of the subfield other than MSB, it is so controlled that the number of the sustaining pulses of the MSB subfield is reduced and the number of the sustaining pulses other than MSB subfield is increased. Another control is that the sustaining pulse number of MSB subfield is reduced without changing that of the subfield other than MSB. Thus, the luminance characteristic of the PDP 16 can be maintained constant irrespectively of the display load factor.

Figure 5:
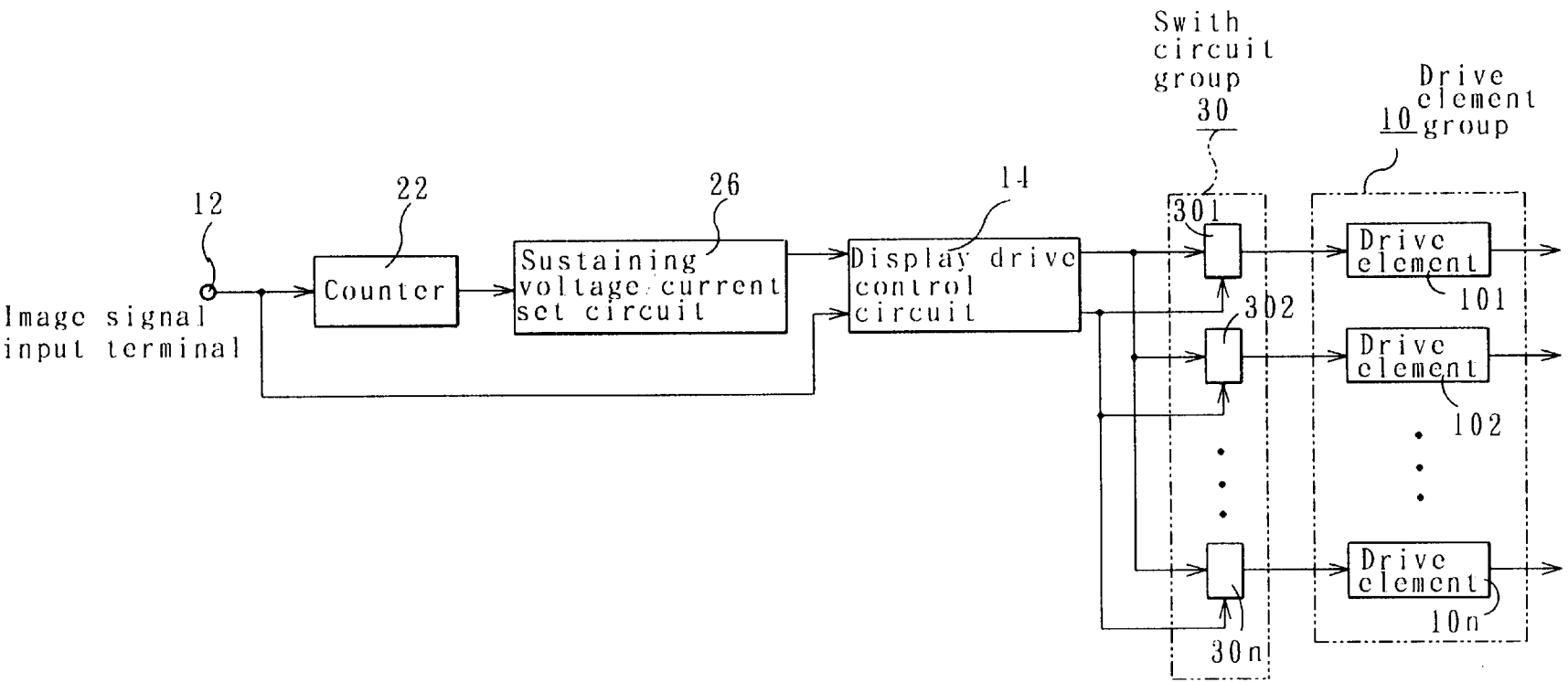
FIG. 5 is another block diagram showing the second embodiment of the drive circuit of the display device according to this invention.
Figure 6:
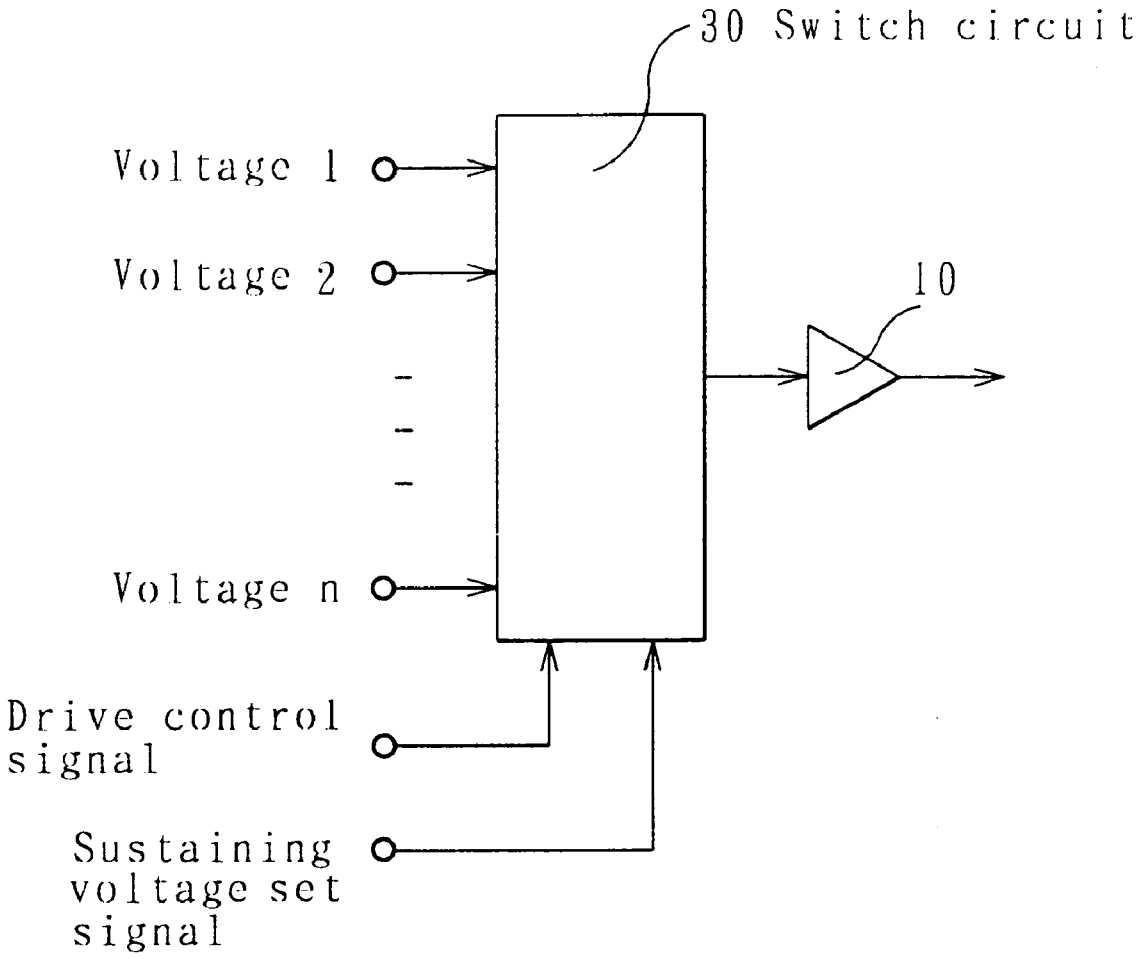
FIG. 6 is a block diagram showing an example of the sustaining voltage/current switching circuit as shown in FIG. 5.

FIGS. 5 and 6 explain the second embodiment of this invention, where the numeral 22 represents the counter as an example of the display load factor detect means. The counter 22 is so designed as to count the drive pixel number (display area) for every one frame or subfield based on the image signal as input into said image signal input terminal 12 to output the counted value.

Coupled on the output side of said counter 22 is a sustaining voltage/current set circuit 26 as an example of the sustaining voltage/current control means, which sets and outputs either the sustaining voltage or sustaining current to the drive pixels for every one frame or one subfield to maintain constant the luminance characteristic of the PDP 16 irrespectively of the largeness of the display load factor based on the counted value of said counter 22.

For these set data, the respective drive element groups 10 take charge of the driving of the plural pixels of PDP 16, and the characteristic representing the relationship between the image signal and emission luminance is measured for the PDP 16 that displayed the multi-tone image by ADS subfield method. The set data is obtained from these data measured.

Said sustaining voltage/current set circuit 26 has been so designed that it does output by setting different voltage levels of voltage 1, voltage 2, . . . voltage n, for instance, based on the counted value of said counter 22.

Connected to the output side of said sustaining voltage/current set circuit 26 is a display drive control circuit 14, on the other input side of which is connected the image signal input terminal 12. The display drive control circuit 14 switches, drives and controls the sustaining voltage/current switch circuit group 30 (301, 302, . . . 30n) based on the image signal as input into said signal input terminal 12 and the sustaining voltage or current as set by the sustaining voltage/current set circuit 26, and drives and control the drive element group 10. At the same time it performs the multi-tone image display by ADS subfield method with the PDP 16 (not shown) as coupled with the output side of the drive element group 10, and maintains always constant the luminance characteristic of the PDP 16 without regard to the largeness of the display load factor.

The foregoing sustaining voltage/current switch circuit 30 consists, for example, of such analog switch as shown in FIG. 6. It has been so built up that the switching action based on the sustaining voltage set signal and the drive control signal from said display drive control circuit 14 sets, at the sustaining voltage/current set circuit 26, and switches the different voltage levels of voltage 1, voltage 2, . . . voltage n as input through the intermediary of said display drive control circuit 14.

Referring now to FIG. 5 the function of the second embodiment of this invention will be described now.

(a) The counter 22 will count the drive pixel number for every one frame or one subfield based on the image signal as input into the image signal input terminal 12, and output the counted value to the sustaining voltage/current set circuit 26. Let us consider, for example, an image where the most of displayed image is composed of the image level "127" (01111111 by 8-bits binary notation) and the small remaining area is composed of an image level "128" (10000000 by 8-bits binary notation). The MSB subfield has a small counted value because its drive pixel number, consequently the display load factor is small, while the subfield other than MSB has a great counted value because its drive pixel number, consequently the display load factor is great.

(b) The sustaining voltage/current set circuit 26 sets and outputs the sustaining voltage or sustaining current based on the counted value of the counter 22. The display drive control circuit 14 switches, drives and controls the sustaining voltage/current switch circuit group 30 based on the image signal as input into the image signal input terminal 12 and the set data as set by the sustaining voltage/current set circuit 26, and drives and control the drive element group 10. At the same time it conducts the multi-tone image display at the PDP 16 by ADB subfield method, and maintains constant the luminance characteristic of the PDP 16.

Let us consider, for example, an image where the most of displayed image is composed of the image level "127" (01111111) and the small remaining area is composed of an image level "128" (10000000). Since the counted value of the MSB subfield is smaller than that of the subfield other than MSB, it is so controlled that the number of the sustaining pulses of the MSB subfield is reduced and the number of the sustaining pulses other than MSB subfield is increased. Another control is that the sustaining voltage or sustaining current of MSB subfield is reduced without changing that of the subfield other than MSB. Thus, the luminance characteristic of the PDP 16 can be maintained constant irrespectively of the display load factor.

When, for instance, the luminance characteristic of PDP 16 is made constant by the control of sustaining voltage irrespectively of the display load factor, the sustaining voltage of the MSB subfield is changed over from the voltage 3 as shown in FIG. 6 into smaller voltage 2.

Figure 7:
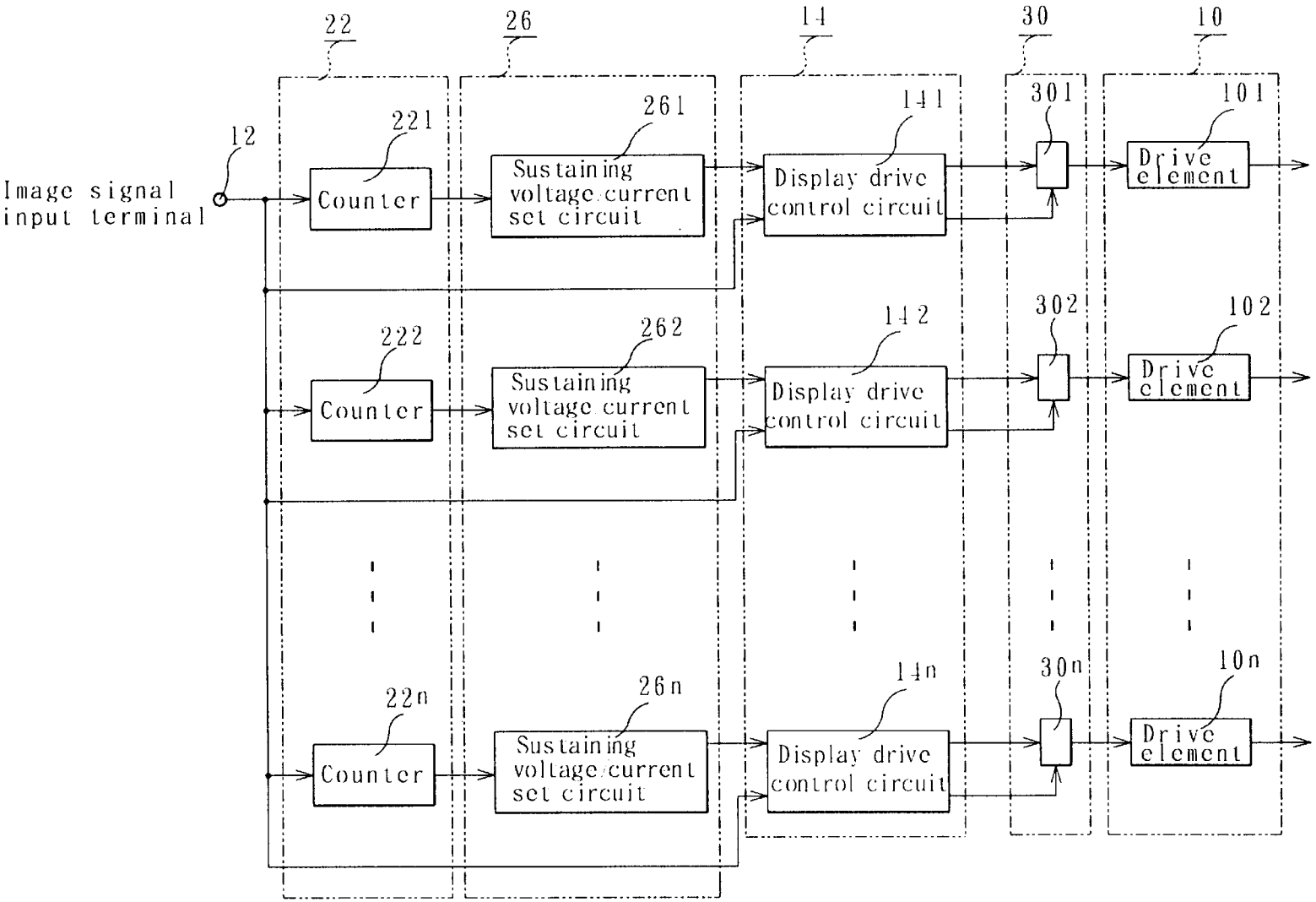
FIG. 7 is another block diagram showing the third embodiment of the drive circuit of the display device according to this invention.

FIG. 7 explains the third embodiment of this invention.

The numeral 22 symbolizes the counter group as an example of the display load factor detect means, The forgoing respective counters 221, 222, . . . 22n count up the drive pixel number (display area) for every one line based on the image signal as input in said image signal input terminal 12 to output the counted value.

Connected to the respective output sides of said counter group 22 is the sustaining voltage/current set circuit group 26 (261, 262, . . . 26n) as an example of the sustaining voltage/current control means, which sets and outputs the sustaining voltage or current for the drive pixels for every one line in order to maintain constant the luminance characteristic of PDP 16 irrespective of the largeness of the display load factor.

These set data are obtained from the measurements of the characteristic representing the relationship between the image signal and emission luminance of the PDP 16 that displayed the multi-tone image by the ADS subfield method with the respective elements of the drive element group 10 taking charge of the driving of the 1-line pixels of PDP 16.

Coupled to the respective output sides of the aforesaid sustaining voltage/current set circuit 26 is the display drive control circuit group 14 (141, 142, . . . 14n), to the input sides of which is coupled the image signal input terminal 12.

Each of the display drive control circuit group 14 switches, drives and controls the sustaining voltage/current switch circuit group 30 (301, 302, . . . 30n) on the basis of the image signal as input in said image signal input terminal 12 and the sustaining voltage or sustaining current as set by the sustaining voltage/current set circuit group 26. At the same time it drives and controls the drive element group 10, and displays multi-tone image by ADS subfield method at the PDP 16 as coupled with the output side of the drive element group 10 to maintain always constant the luminance characteristic of the PDP 16 irrespectively of the largeness of the display load factor.

The function of the third embodiment of this invention will be explained now referring to FIG. 7.

(a) The counter group 22 counts up the number of drive elements for every one line based on the image signal as input in the image signal input terminal 12, and outputs the counted value to the sustaining voltage/current set circuit group 26.

Let us consider, for example, an image where the most of displayed image is composed of the image level "127" (01111111) and the small remaining area is composed of an image level "128" (10000000). The MSB subfield has a small counted value because its drive pixel number, consequently the display load factor is small, while the subfield other than MSB has a great counted value because its drive pixel number, consequently the display load factor is great.

(b) The sustaining voltage/current set circuit group 26 sets and outputs the sustaining voltage or sustaining current based on the counted value of the counter group 22. The display drive control circuit group 14 switches, drives and controls the sustaining voltage/current switch circuit group 30 based on the image signal as input into the image signal input terminal 12 and the set data as set by the sustaining voltage/current set circuit group 26, and drives and controls the drive element group 10. At the same time it conducts the multi-tone image display at the PDP 16 by ADB subfield method, and maintains constant the luminance characteristic of the PDP 16.

Let us consider, for example, an image where the most of displayed image is composed of the image level "127"

(01111111) and the small remaining area is composed of an image level "128" (10000000). Since the counted value of the MSB subfield is smaller than that of the subfield other than MSB, it is so controlled that the number of the sustaining pulses of the MSB subfield is reduced and the number of the sustaining pulses other than MSB subfield is increased. Another control is that the sustaining pulse number of MSB subfields is reduced without changing that of the subfield other than MSB. Thus, the luminance characteristic of the PDP 16 can be maintained constant irrespectively of the display load factor.

In the foregoing first, second and third embodiments, an explanation was made on the case where this invention is used for the display device that displays multi-tone image by the ADS subfield method, but the invention is not limited to this type of embodiment. The present invention can be used at least and also to a display device where the respective drive elements take charge of the driving of plural pixels whose display luminance changes as changes the number of sustaining pulses, sustaining voltage or sustaining current.

Now the fourth embodiment of this invention will be explained referring to FIGS. 8(*a*) and 8(*b*).

Connected to the image signal input terminal 12 is the display area detect circuit group 20 (201, 202, . . . 20m) through the intermediary of the half tone display circuit 31, while the display drive control circuit 14, the drive element group 10 and PDP 16 are sequentially connected in this order to the output side of the display area detect circuit group 20m.

FIG. 8(*b*) shows up an error variance circuit as an example of aforesaid half tone display circuit 31. The error variance circuit consists of a vertical adder 32 that adds vertical reproduced error to n-bits input image signal as input into the image signal input terminal 12, a horizontal adder 34 that adds a horizontal reproduced error to the output signal of this vertical adder 32, an error detect circuit 36 that outputs an error weighting signal by detecting and weighting the difference between the output signal of the horizontal adder 34 and the correction data as preset at ROM among others, a h-line delay circuit 38 that delays by h-lines the error weighting signal as output from the error detect circuit 36 and outputs it to the vertical adder 32, d-dot delay circuit 40 that delays by d-dots the error weighting signal as output from the error detect circuit 36 and outputs it as reproduced error to the horizontal adder 34, and a bit convert circuit 44 that converts the n-bits image signal as output from the horizontal adder 34 into m-bits ($m \leqq n-1$) image signal and outputs it to the aforesaid display area detect circuit 20 through the intermediary of the output terminal 42.

Said display area detect circuit 20 comprises a display load factor detect circuit (counter, for instance) that detects the display load factor for every certain duration (one frame, one subfield or one line) and sustaining pulse control circuit (for example, LUT [Look Up Table]) that controls the sustaining pulse (for example, pulse number, sustaining voltage or sustaining current) so that the luminance characteristic of PDP can be maintained constant on the basis of the detect output of the display load factor detect circuit. More materially, the LUT as an example of the sustaining pulse control circuit stores beforehand in memory the data of sustaining pulse (for example, pulse number, sustaining voltage or sustaining current) for the drive pixels for every one frame, one subfield or one line in order to maintain constant the luminance characteristic of PDP 16 irrespectively of the largeness of the display load factor with the counted value of the counter as an example of the display load factor detect circuit, as an address, The foregoing display drive control circuit 14 drives and controls the drive element group 10 using the data of sustaining pulse (for example, pulse number, sustaining voltage or sustaining current) as obtained from said display area detect circuit 20 and maintains always constant the luminance characteristic of PDP 16 irrespective of the largeness of the display load factor.

Now the function of the embodiment shown in FIG. 8 will be explained.

(a) The half tone display circuit 31 adds vertical and horizontal reproduced errors to the n-bits input image signal as input, by the adders 32 and 34 into the image signal input terminal 12, while the error detect circuit 36 detects and weights the difference between the output signal of the horizontal adder 34 and the correction data. The delay circuits 38 and 40 delay by h lines and d dots the error weighting signal as output from the error detect circuit 36 to output it to the adders 32 and 34. The bit convert circuit 44 converts the n-bits signal into m-bits ($m \leqq n-1$) image signal and outputs it to the display area detect circuit 20 through the intermediary of the output terminal 42.

Thus the half tone display circuit 31 takes as an error the difference between the image level to be displayed and the drive level as displayed to disperse it over the image in both horizontal and vertical directions. The half tone display by such error variance will reduce the number of the subfields as driven by the downstream subfield driving method (for example, ADS subfield method) and compensates for the tones corresponding to this reduction by the half tone, that is, maintains the number of tones to be displayed.

(b) The display area detect circuit 20 detects the display load factor for every certain duration (for example, one frame) based on the m-bits image signal as output from the half tone display circuit 31, counts up the number of drive pixel by the counter and controls the sustaining pulse so that the luminance characteristic of PDP 16 can be maintained constant with this counted value as, for example, an address on the basis of the detect output (for example, outputs the number of sustaining pulses, the content of the address from the LUT).

Let us consider, for example, an image where the most of displayed image is composed of the image level "127" (01111111) and the small remaining area is composed of an image level "128" (10000000). Since the display load factor (counted value, for instance) of the MSB subfield is smaller than that of the subfield other than MSB, it is so controlled that the number of the sustaining pulses of the MSB subfield is reduced and the number of the sustaining pulses other than MSB subfield is increased. Another control is that the sustaining voltage or sustaining current of MSB subfield is reduced without changing that of the subfield other than MSB. Thus, the luminance characteristic of the PDP 16 can be maintained constant irrespectively of the display load factor.

(c) The display drive control circuit 14 controls the drive element group 10 using the sustaining pulses as output from the display area detect circuit 20, displays multi-tone image by the subfield drive method (ADS subfield method) at the PDP 16, and maintains constant the luminance characteristic of the PDP 16.

The foregoing fourth embodiment has been described adopting a case where an error variance circuit is used as an example of the half tone display means, but this invention is not limited to this embodiment. Any embodiment will do if n-bits input image signal can be converted into m-bits ($m \leqq n-i$) one and the intermediate level thereof can be obtained from the neighboring drive level. For instance, the configuration of the embodiment may use such means as FRC (Frame Rate Control).

In the foregoing embodiments, the first to the fourth, we explained the case where the display panel of the display device is PDP, but this invention is not limited to this. The invention may include such a case where the display panel is a liquid crystal display panel (LCDP) display device.

What is claimed is:

1. In a display device having plural drive elements where each drive element takes charge of the driving of plural pixels and the display luminance changes with the change of the number of the sustaining pulses to be supplied from said respective drive elements to a display panel based on the input image signal, a drive circuit for the display device comprising a display load factor detect means that detects the display load factor for every certain duration based on said input image signal and a sustaining pulse control means that controls the number of sustaining pulses so that the luminance characteristic of said display panel can be maintained constant on the basis of the detect output of the display load factor detect means.

2. The display device as claimed in claim 1, wherein the display device timeshares one screen display duration of the display panel into plural display durations corresponding to the display tone and displays multitone image by weighting the number of sustaining pulses for each divided display duration, the display load factor detect means includes a counter that counts up the number of the drive pixels for every one of display duration out of one screen of display duration and one division display duration, and the sustaining pulse control means is a sustaining pulse control circuit that controls the number of sustaining pulses based on the counted value of said counter.

3. In a display device having plural drive elements where each drive element takes charge of the driving of plural pixels and the display luminance chances with the change of the number of the sustaining pulses to be supplied from said respective drive elements to a display panel based on the input image signal, a drive circuit for the display device comprising a display load factor detect means including a counter that counts up the number of the drive pixels for every one of display duration out of one screen of display duration and one division display duration to detect the display load factor based on said input image signal and a sustaining pulse control circuit comprising a look up table which stores beforehand in memory the number of sustaining pulses to maintain constant the luminance characteristic of the display panel; and wherein the display device timeshares one screen display duration of the display panel into plural display durations corresponding to the display tone and displays multitone image by weighting the number of sustaining pulses for each divided display duration.

4. In a display device having plural drive elements where each drive element takes charge of the driving of plural pixels and the display luminance changes with the change of sustaining voltage or sustaining current to be supplied from said respective drive elements to a display panel on the basis of an input image signal, a drive circuit for the display device comprising a display load factor detect means that detects the display load factor for a certain duration based on said input image signal and a sustaining voltage/current control means that controls either the sustaining voltage or the sustaining current so that the luminance characteristic of said display panel can be maintained constant on the basis of the detect output of the display load factor detect means.

5. The display device claimed in claim 4, wherein the display device timeshares one screen of display duration for the display panel into plural display durations corresponding to display tones, the display load factor detect means includes a counter that counts up the number of drive pixels for every one screen of duration, and the sustaining voltage/current control means comprises a sustaining voltage/current control circuit that controls either the sustaining voltage or the sustaining current on the basis of the counted value of said counter.

6. The display device claimed in claim 4, wherein the display device timeshares one screen display duration of the display panel into display durations corresponding to display tones, the display load factor detect means includes a counter that counts up the number of drive pixels for every one line of display duration, and the sustaining voltage/current control means comprises a sustaining voltage/current control circuit that controls either the sustaining voltage or the sustaining current on the basis of the counted value of said counter.

7. In a display device having plural drive elements, each drive element taking charge of the driving of plural pixels, wherein the display device timeshares one screen display duration of a display panel into plural display durations corresponding to display tones and weights the number of sustaining pulses for each divided display duration to display a multitone image, the display device being provided with a halftone display means that converts a n-bit input image signal, wherein n is an integer not less than 2, into a m-bit ($m \leqq n-1$) image signal and obtains an intermediate level from a neighboring drive level, and a display area detect means detects the display area for every certain duration based on the m-bit image signal of said halftone display means and maintains constant the luminance characteristic of said display panel.

8. The display device claimed in claim 7, wherein the halftone display means is an error variance circuit that takes as an error the difference between an image level to be displayed and the drive level as displayed and disperses this difference over the surrounding multitone image.

9. The display device claimed in claim 7, wherein the display area detect means includes a display load factor detect circuit that detects a display load factor for every certain duration and a sustaining pulse control circuit that controls the number of sustaining pulses so that the luminance characteristic of the display panel can be maintained constant.

10. The display device claimed in claim 7, wherein the display area detect means includes a display load factor detect circuit that detects a display load factor for every certain duration and a sustaining voltage/current control circuit that controls the sustaining voltage or the sustaining current so that the luminance characteristic of the display panel can be maintained constant.

11. The display device claimed in claim 10, wherein the display load factor detect circuit includes a counter that counts up the number of drive pixels for every one screen display duration and the sustaining voltage/current control circuit controls either the sustaining voltage or the sustaining current based on the counted value of said counter.

12. The display device claimed in claim 10, wherein the display load factor detect circuit includes a counter that counts up the number of drive pixels for every one line display duration and the sustaining voltage/current control circuit controls either the sustaining voltage or the sustaining current based on the counted value of said counter.

13. A display device comprising:

a counter that counts the number of drive pixels from an input image signal;

a set circuit that outputs values based on the counted number of drive pixels of the counter;

a display drive control circuit that receives the values from the set circuit and the input image signal, the display drive control circuit providing an output;

a drive element group receiving the output of the display drive control circuit; and a display panel displaying an image having a luminance characteristic maintained constant based on the counted number of drive pixels of the counter and the set circuit.

14. The display device of claim 13, wherein the output of the display drive control circuit comprises a divided time frame of the display panel, divided into plural subfields and weighted as a sustaining pulse number for each subfield to display a multi-tone image.

15. A display device comprising:

a counter that counts the number of drive pixels from an input image signal;

a set circuit comprising a look-up table that outputs values based on the counted number of drive pixels of the counter;

a display drive control circuit that receives the values from the set circuit and the input image signal, the display drive control circuit providing an output;

a drive element group receiving the output of the display drive control circuit; and a display panel displaying an image having a luminance characteristic maintained constant based on the values output by the set circuit.

16. The display device of claim 13, wherein the set circuit comprises a sustaining voltage/current control means that controls sustaining voltage or sustaining current supplied to the display drive control circuit such that the luminance characteristic of said display panel remains constant.

* * * * *